US005890702A

United States Patent [19]

Lubore

[11] Patent Number: 5,890,702

[45] Date of Patent: Apr. 6, 1999

[54] ORNAMENTAL FENCE

[76] Inventor: Terry S. Lubore, 746 Chapel Hill Rd., Burlington, N.C. 27215-6452

[21] Appl. No.: 859,192

[22] Filed: May 20, 1997

[51] Int. Cl.[6] ..... E04M 17/00

[52] U.S. Cl. ..... 256/19; 256/1; 256/24

[58] Field of Search ..... 256/19, 1, 24, 256/13.1, 25–29; 40/406; 160/236, 40, 44; 52/311.1, 786.11

[56] References Cited

U.S. PATENT DOCUMENTS

| | | | |
|---|---|---|---|
| 3,425,630 | 2/1969 | Fessler, Sr. | 256/1 X |
| 3,640,796 | 2/1972 | Cotelle | 52/786.11 |
| 3,865,309 | 2/1975 | Greenhalgh | 256/1 X |
| 3,933,311 | 1/1976 | Lemelson | 256/19 X |
| 3,981,294 | 9/1976 | Deminet et al. | 52/786.11 X |
| 4,381,763 | 5/1983 | Kahl | 256/1 X |
| 4,384,419 | 5/1983 | Parr | 40/406 |
| 4,928,412 | 5/1990 | Nishiyama | 40/406 X |
| 4,946,306 | 8/1990 | Yodock | 256/19 X |
| 5,538,455 | 7/1996 | James, II | 40/406 X |

FOREIGN PATENT DOCUMENTS

| | | | |
|---|---|---|---|
| 275874 | 11/1989 | Japan | 256/1 |

*Primary Examiner*—Harry C. Kim
*Attorney, Agent, or Firm*—Mills Law Firm PLLC

[57] ABSTRACT

An ornamental fence which can be changed from one desired color to another includes hollow pickets and rails formed of a thin wall translucent material substantially free of pigmentation having sufficient transparency such that exterior surface of the pickets and rails assume the coloration of a fluid contained therewithin as admitted to the interior through exteriorly accessible drain and fill openings.

4 Claims, 3 Drawing Sheets

ORNAMENTAL FENCE

BACKGROUND OF INVENTION

Field of Invention

This invention relates to a novel fence, and more particularly to an ornamental fence or to a section of ornamental fence which can readily be changed from one desired color to another.

Fences most commonly in use today are made of wood, metals, such as chain link or ornamental iron, and masonry, such as brick, cinder or concrete block, and monolithic structure, or combinations thereof In order to obtain a desired color of such fences, it is necessary to apply a coating on the outer surface thereof, such as by painting, spraying, or dipping. When one desires a different color, it is necessary to apply a coating of the desired color to the surface of the fence, usually over the previous coating. If several coats have been previously applied on the fence, the coating tends to become too thick and will peel off, requiring laborious scraping or removing of the old coating to present a smooth surface before applying a new surface coating. All of this is not only expensive, but tedious and laborious.

It is an object of this invention to fabricate a novel fence that eliminates all of the above objectionable features involved in producing a different color to a fence.

It is a further object to fabricate a novel fence that can be changed to any desirable color quickly and easily, and without applying a different surface coating or any coating.

It is a still further object to fabricate a novel fence that can be cheaply manufactured, that is strong and durable, and can be caused to assume any desired color cheaply and without employing any skilled labor.

My novel fence is made from any translucent material, such as glass, Plexiglas or any of the well known plastics. The selected material is colorless, that is, substantially free from pigmentation, and is hollow throughout. The fence is made up of one or more sections, each section being hollow, and when more than one section is employed, adjacent sections are interconnected so that the hollow interior of one section is in communication with the hollow interior of an adjoining section, so that the hollow interiors of adjoining sections form a continuous flow path for a fluid. Fill and drain openings are provided whereby the hollow interior of the sections may be filled with a colored liquid, which completely fills the hollow interior. Since the fence sections are made of translucent material, the entire section assumes the color of the liquid within the hollow interior. It is obvious, therefore, that it is a simple matter to change colors, involving merely the draining of the liquid within the fence section or sections, and the substitution of another liquid having the desired color. On the other hand, the color change can be accomplished merely by adding a suitable dye to the liquid within the section or sections, selecting a dye which will give the desired color when mixed with the color already within the hollow section or sections. By blocking off adjoining sections, it is possible to attain a pleasing effect by adding different colored liquids to adjoining sections, so that each section of the fence may have the desired color, which may be the same or different from the color of the adjoining section.

The attainment of the above, as well as other objects and advantages, will be more clearly understood from a consideration of the following detailed specification and the accompanying drawings in which.

Figure 1:
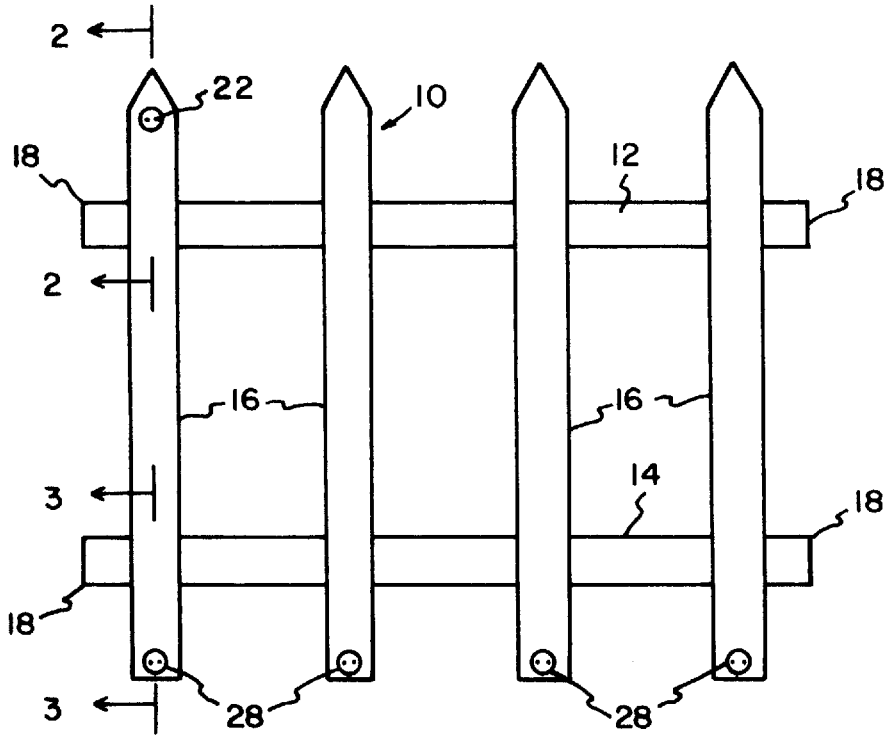
FIG. 1 is an elevation of a first embodiment of the invention.
Figure 2:
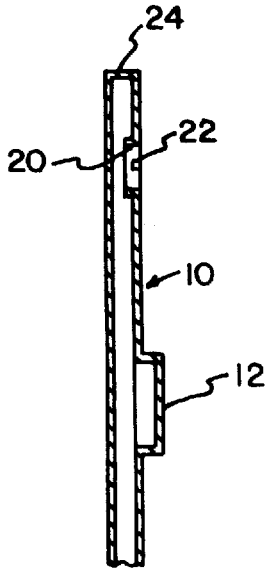
FIG. 2 is a sectional view of the fill opening of FIG. 1 being taken along the line 2—2 thereof.
Figure 3:
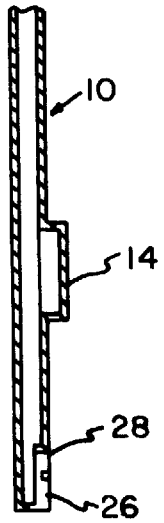
FIG. 3 is a sectional view of the drain opening of FIG. 1, being taken along the line 3—3 thereof.

Referring to the drawings, in which the same element is designated by the same reference character, and particularly to FIGS. 1, 2 and 3, there is shown a section of a picket fence designated in its entirety by the numeral 10, comprising an upper horizontal rail 12, a lower horizontal rail 14, and a plurality of parallel, spaced, pickets 16. The ends of the rails 12 and 14 are extended beyond the end pickets to form nipples 18 for a purpose to be explained later.

The rails 12 and 14, and the pickets 16, are all hollow and are interconnected to form a continuous flow passage. One or more pickets 16 are provided, near the upper end thereof, with a filling opening 20 having threads to receive a threaded closure plug 22. The lower end of each of the pickets 16 has a drain outlet 26, threaded to receive a threaded drain plug 28. Each of the plugs 22 and 28 has a pair of spaced recesses to receive a spanner wrench. At the upper end of each picket 16 there is provided a bleed opening 24.

The entire fence section 10 is fabricated from a suitable translucent material such as glass, Plexiglas, or any other plastic material. While such material may be colored or tinted, it is preferred that it be free from any pigmentation.

The section or sections 10 of the fence may be filled with a liquid having the desired color, which liquid may be admitted through the filling openings 20 after removing the plug 22. The plugs 28 must be in place to prevent the escape of the liquid.

As the fence section or sections are being filled, the displaced air will escape through the bleed openings 24. If the fence is erected on a hillside where the upper end of some pickets may be at a higher elevation than others, it may be necessary to provide float controlled valves to close the bleed openings when that particular picket is full. When more than one section 10 is employed, adjoining sections may be interconnected by joining the nipples 18 with suitable unions, in a well known manner.

From the foregoing, it is evident that the colored liquid will fill the entire hollow interior of section 10, including the rails 12 and 14, and the pickets 16 and nipples 18. As the sections are made of translucent material, the entire fence will assume the color of the liquid within the same, giving a very pleasing appearance. If one should desire that adjoining sections of the fence have different colors, the nipples 18 can be plugged to prevent the liquid from passing from one section to another, and each section can be isolated and filled with a liquid of the desired color. Suitable dyes for the liquid should be used to prevent any permanent coating of the interior walls of the sections. In freezing climates, a suitable antifreeze should be used to prevent freezing within the sections.

When one wishes to change the color of the fence, or of a section of the fence, a suitable dye can be added to the liquid therein, or the drain plugs 28 can be removed to drain the liquid from each section. When drained the plugs are replaced and the fence section is refilled with a liquid of the desired color.

Figure 4:
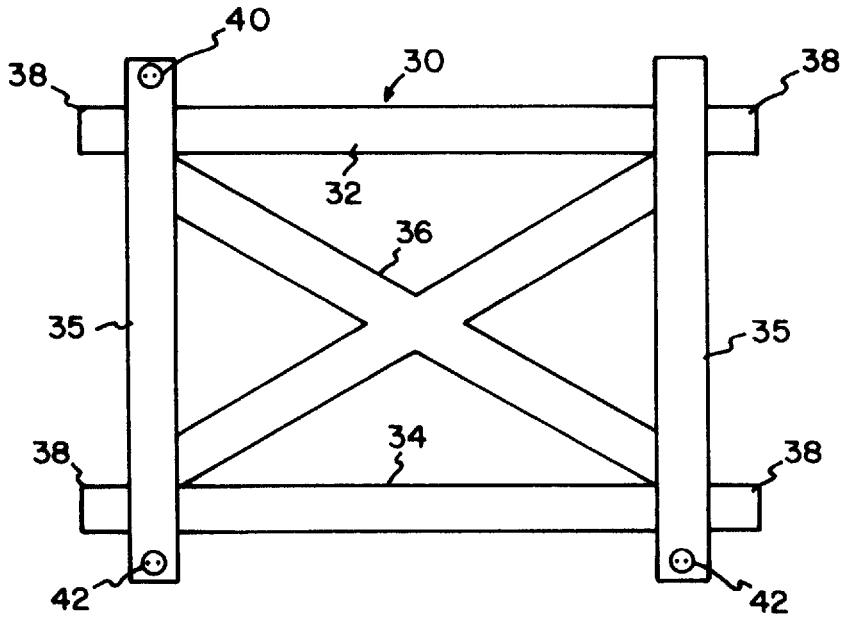
FIG. 4 is an elevation of a second embodiment of the invention.

FIG. 4 illustrates a second embodiment having the form of an X-frame, comprising a section 30 having an upper horizontal rail 32, a lower horizontal rail 34, a pair of end posts 35, and a structure forming an X-frame 36. Extensions of the upper and lower rails 32 and 34 form nipples 38 for attachment, by unions, with adjoining sections. The ends of the X-frame 36 connect with the end posts 35. The upper end of each end post has a bleed opening, not shown. All of the members 32, 34, 35, 36 and 38 are hollow and are interconnected to form a continuous flow passage. As in the embodiment shown in FIG. 1, the embodiment illustrated in FIG. 4 is fabricated from translucent material, and is filled through the openings having the filling plugs 40 and is drained through the openings having the drain plugs 42. Similarly, this embodiment may be filled with colored liquids, and sections may be interconnected to form longer fences.

Figure 5:
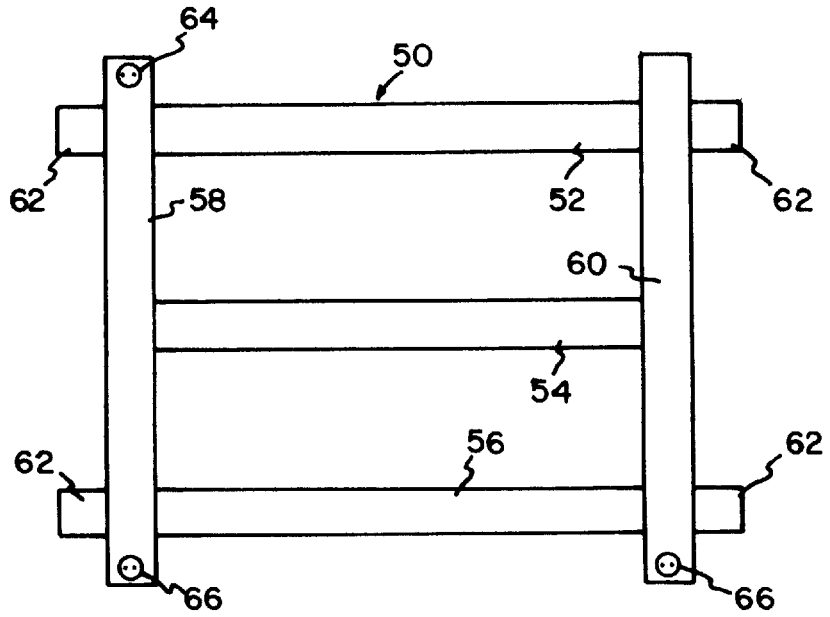
FIG. 5 is an elevation of a third embodiment of the invention.

The embodiment illustrated in FIG. 5, designated in its entirety by the numeral 50, comprises a section of a rail fence having a top rail 52, middle rail 54 and a bottom rail 56, each rail connected with a pair of end posts 58 and 60. Extensions of the top rail 52 and bottom rail 56 form nipples 62, which may be used to interconnect adjoining sections 50. Each section is provided with at least one filling opening having a closure plug 64, in the upper end of the end post or posts, and a drain outlet at the lower end of each end post, receiving drain plugs 66. The upper end of each end post 60 has a bleed opening, now shown.

The rails 52, 54, 56, and end posts 58 and 60, as well as the nipples 62, are hollow and are interconnected to form a continuous flow passage. As in the case of the previous embodiments, the section 50 is fabricated from a suitable translucent material, and may be filled with a colored liquid to attain the desired color effect.

Figure 6:
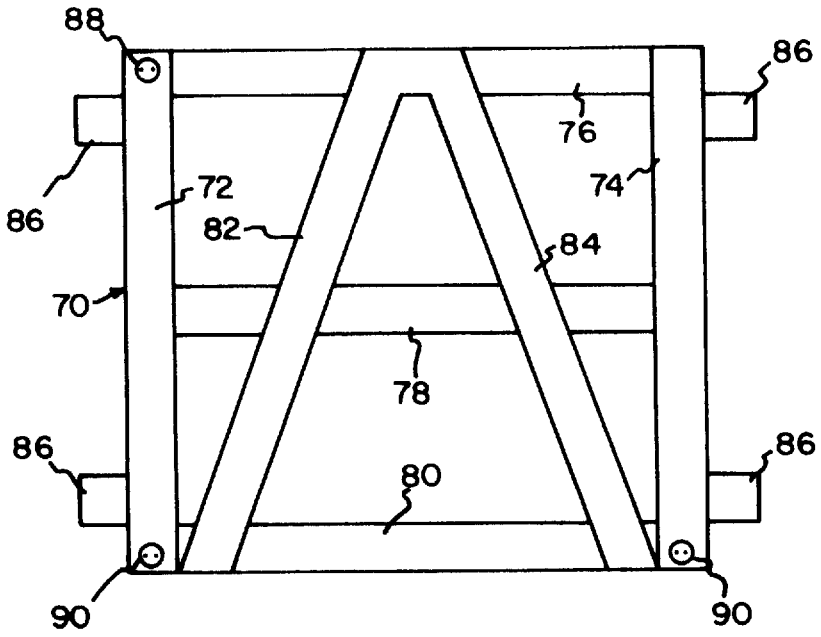
FIG. 6 is an elevation of a fourth embodiment of the invention.

A fourth embodiment of the invention is shown in FIG. 6, which shows an A-frame section designated in its entirety by the numeral 70, and comprises a pair of spaced end posts 72 and 74, a top rail 76, middle rail 78 and bottom rail 80, and a pair of diagonals 82 and 84 forming the letter A. At least one fill opening is located in the upper end of the end posts 72 and/or 74, closed by a plug 88, and at least one drain outlet at the lower end of the end posts, closed by drain plugs 90. Suitable bleed openings, now shown, are provided in the upper ends of the end posts 72 and 74.

All of the elements 72, 74, 76, 78, 80, 82, 84 and 86 are hollow and are made from translucent materials, and are interconnected to form a continuous flow passage. As in the case of the previous embodiments, each section may be filled with a liquid having the desired color.

Figure 7:
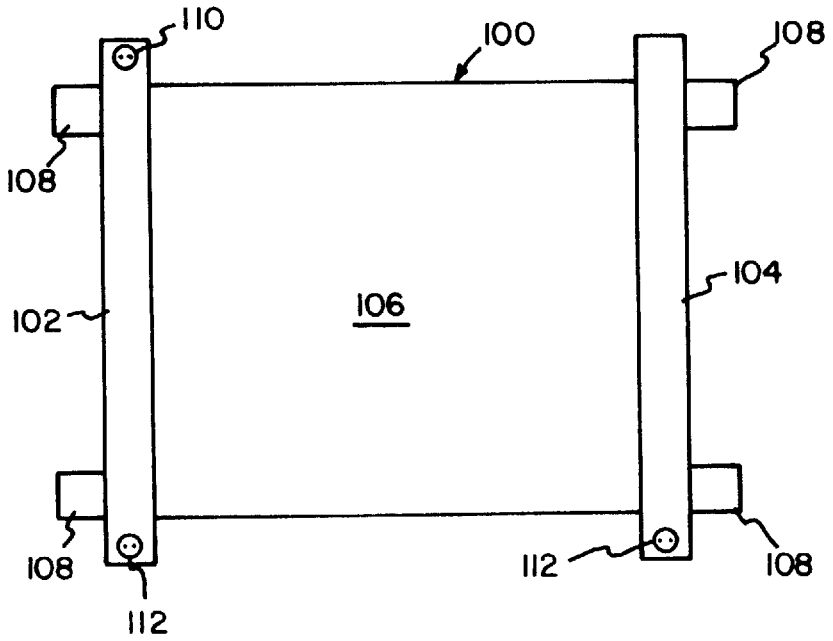
FIG. 7 is an elevation of a fifth embodiment of the invention.

A fifth embodiment of the invention is shown in FIG. 7, which illustrates a panel section 100 having a pair of spaced end posts 102 and 104 interconnected by a panel 106. Each of the end posts 102 and 104 has a pair of spaced, aligned, nipples 108 permitting interconnection of adjoining fence sections. One or more openings in the upper ends of the end posts 102 and/or 104, closed by filling plugs 110, and openings in the bottom of each end post, closed by drain plugs 112, permit the filling and draining of the hollow interior of the section 100. Bleed openings in the upper ends of the end posts, not shown, permit the venting of air when filling.

Each of the elements comprising the section 100 is hollow and all are interconnected to form a continuous flow passage. The section is fabricated from translucent materials, and may be filled with colored liquids as described in the preceding embodiments.

It is apparent, from the foregoing, that I have invented a novel fence structure, which is not only useful in enclosing areas, but also presents a pleasing appearance, and which is capable, merely by adding a suitable dye, or by draining and refilling with a liquid having a different color, of easily and quickly changing in color. the sections may be fabricated in large sizes for fencing in large areas, such as yards, in intermediate sizes for fencing in flower gardens, fish ponds, and in small sizes for ornamental fences for displays, such as in show windows, or for Christmas scenes and the like. The sections may be supported by any well known supporting means, such as wooden, metal, or concrete fence posts.

It will be understood that various changes may be made in the details of construction of the sections disclosed herein without departing from the principles of the invention and the scope of the annexed claims.

I claim:

1. An ornamental fence having an exterior coloration of a fluid contained therewithin, said ornamental fence comprising: first and second elongated hollow vertically extending pickets; first and second elongated hollow horizontally extending rails structurally connected to said pickets, said pickets and said rails being defined by a thin exterior surface formed of a translucent material and establishing a fluid containing reservoir in each of said pickets and a fluid containing reservoir in each of said rails; fluid passages formed in said pickets and said rails fluidly interconnecting said fluid containing reservoirs in said pickets with said fluid containing reservoirs in said rails, said translucent material being substantially free of pigmentation to provide a transparency to said exterior surface enabling said pickets and said rails to assume the coloration of the fluid contained in said fluid containing reservoirs; a filling opening in an upper end of at least one of said pickets for admitting said fluid into said fluid containing reservoirs of said pickets and through said fluid passages into said fluid containing reservoirs of said rails; and a draining opening in a lower end of at least one of said pickets for draining the fluid in the fluid containing reservoirs; and said fluid having the coloration admitted through said filling openings and filling said fluid containing reservoirs whereby said coloration of said fluid imparts a similar coloration to said exterior surfaces of said pickets and said rails.

2. An ornamental fence having an exterior coloration of a fluid contained therewithin, said ornamental fence comprising: first and second elongated picket members interconnected by first and second rail members extending transversely therebetween, said picket members and said rail members being defined by a thin exterior surface formed of a translucent material and establishing a fluid containing reservoir in each of said picket members and a fluid containing reservoir in each of said rail members; a fluid passage formed in said picket members and said rail members fluidly interconnecting said fluid containing reservoirs in said picket members with said fluid containing reservoirs in said rail members, said translucent material being substantially free of pigmentation to provide a transparency to said exterior surface enabling said picket members and said rail members to assume the coloration of the fluid contained in said fluid containing reservoirs; a filling opening in one end of at least one of said picket members for admitting the fluid into said fluid containing reservoirs of said picket members and through said fluid passage into said fluid containing reservoirs of said rail members; and a draining opening in the other end of at least one of said picket members for draining the fluid in the fluid containing reservoir whereby said coloration of said fence may be changed by changing the coloration of said fluid.

3. The ornamental fence as recited in claim 2 wherein said picket members and said rail members are formed of a transparent plastic material substantially free of pigmentation.

4. The ornamental fence as recited in claim 2 wherein said rail members are inclined with respect to said picket members.

* * * * *